United States Patent [19]

Brooks et al.

[11] Patent Number: 4,760,818

[45] Date of Patent: Aug. 2, 1988

[54] VAPOR PHASE INJECTOR

[75] Inventors: Mark A. Brooks, Sterling Heights; Robert E. Fallis, Milford, both of Mich.

[73] Assignee: Allied Corporation, Morris Township, Morris County, N.J.

[21] Appl. No.: 942,526

[22] Filed: Dec. 16, 1986

[51] Int. Cl.[4] ..... F02P 19/00; F02B 9/08

[52] U.S. Cl. ..... 123/298; 123/272; 123/557

[58] Field of Search ..... 123/298, 557, 558, 272, 123/145 A, 145 R, 142.5 R, 179 H, 276; 219/270; 431/262, 268; 361/266

[56] References Cited

U.S. PATENT DOCUMENTS

| | | | |
|---|---|---|---|
| 4,245,589 | 1/1981 | Ryan | 123/298 |
| 4,345,555 | 8/1982 | Oshima et al. | 123/272 |
| 4,538,583 | 9/1985 | Earl | 123/557 |
| 4,572,146 | 2/1986 | Grünwald et al. | 123/298 |
| 4,603,667 | 8/1986 | Grünwald et al. | 123/298 |
| 4,622,944 | 11/1986 | Earl | 123/557 |
| 4,627,405 | 12/1986 | Imhof et al. | 123/298 |

*Primary Examiner*—Raymond A. Nelli

*Attorney, Agent, or Firm*—Markell Seitzman; Russel C. Wells

[57] ABSTRACT

A fuel injector, system and method comprising means for ejecting fuel directly into a cylinder (14) an engine through a non-conductive, heat storing element. The element including a nozzle (44) portion comprising a preferably ceramic body having a narrow, first passage (158) in communication with a conical second portion (164). The two portions cooperating to cause the fuel to flow turbulently therethrough. The nozzle further includes a heater (174) for elevating the temperature to the nozzle to a predetermined temperture. In this manner, as the fuel contacts the heated nozzle it is atomized. In one embodiment of the invention a solid ceramic body is employed. In another embodiment, the nozzle (178) is formed by a plurality of stacked ceramic disks which include a central opening (182) therethrough and a plurality of heating elements (184), one for each disk. The openings (182) are sized to approximate the continuous conical portion of the solid body nozzle. A control (45) is provided for electrically heating the nozzle (44,178) during certain operating intervals of the engine and a method of operating the engine is described which permits the removal of the electrical energy and permits the nozzle to thereafter be heated by the heat of the combustion process in the cylinder.

27 Claims, 3 Drawing Sheets

FIG.8
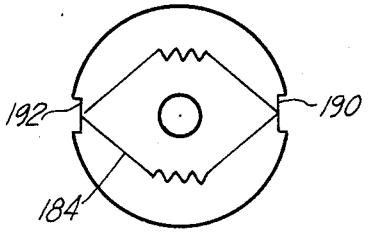
FIG.11
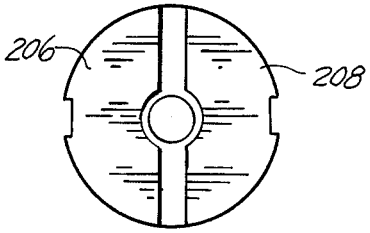
FIG.7
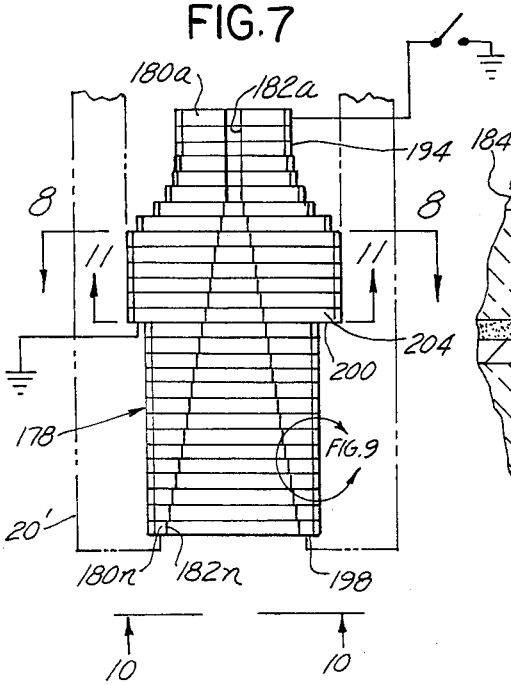
FIG.9
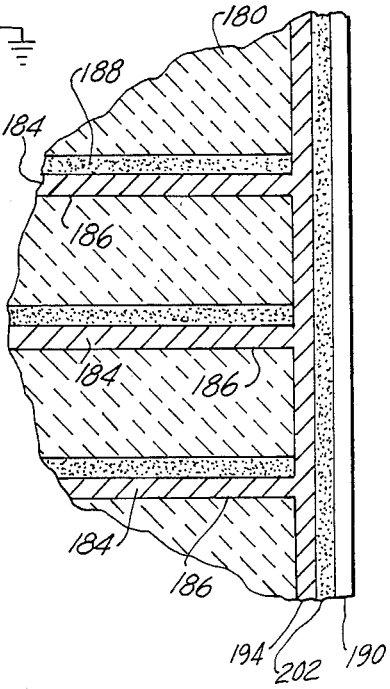
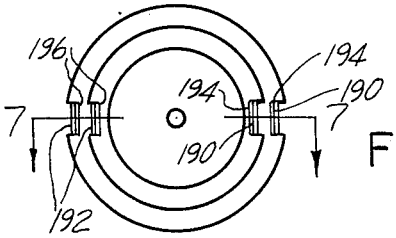
FIG.10

VAPOR PHASE INJECTOR

BACKGROUND AND SUMMARY OF THE INVENTION

This invention relates to a diesel fuel injector and more specifically to an injector which incorporates a heating apparatus for atomizing diesel fuel as it is directly injected into a cylinder or pre-chamber of an engine.

With regard to diesel engines it is appreciated that combustion is enhanced by delivering finely atomized fuel to the combustion chamber.

U.S. Pat. No. 4,345,555 mixes fuel with incoming air upstream of the cylinder. Fuel is heated by continuously supplying electrical energy to an ignition plug. In contrast, the present invention contemplates a vapor phase injector positioned directly within a cylinder or prechamber thereof. The injector includes a ceramic nozzle which finely atomizes the fuel. Atomization is enhanced by neating the nozzle to a predetermined temperative during engine start up. Once the engine is running the nozzle need not be heated by electrical means, since the nozzle it will absorb heat from the combustion process.

It is an object of the present invention to finely atomize fuel by injecting same through a heated nozzle. Another object of the present invention is to use the heat of the combustion process to heat the nozzle. An additional object of the present invention is to provide a nozzle having a predetermined temperature gradient thereacross.

Accordingly, the invention comprises:

A fuel injector, system and method comprising means for ejecting fuel into an engine through a non-conductive, heat storing element. The element including a nozzle portion comprising a preferably ceramic body having a narrow, first passage in communication with a conical second portion. The two portions cooperating to cause the fuel to flow turbulently therethrough. The nozzle further includes a heater for elevating the temperature to the nozzle to a predetermined temperature. In this manner, as the fuel contacts the heated nozzle it is atomized. In one embodiment of the invention a solid ceramic body is employed. In another embodiment, the nozzle is formed by a plurality of stacked ceramic disks which include a central opening therethrough and a plurality of heating elements, one for each disk. The openings are sized to approximate the continuous conical portion of the solid body nozzle. Means are provided for electrically heating the nozzle during certain operating intervals of the engine and a method of operating the engine is described which permits the removal of the electrical energy and permits the nozzle to thereafter be heated by the heat of the combustion process in the cylinder.

Many other objects and purposes of the invention will be clear from the following detailed description of the drawings.

BRIEF DESCRIPTION OF THE DRAWINGS

In the drawings:

FIGS. 7–11 illustrate an alternate embodiment of the invention.

DETAILED DESCRIPTION OF THE DRAWINGS

Figure 1:
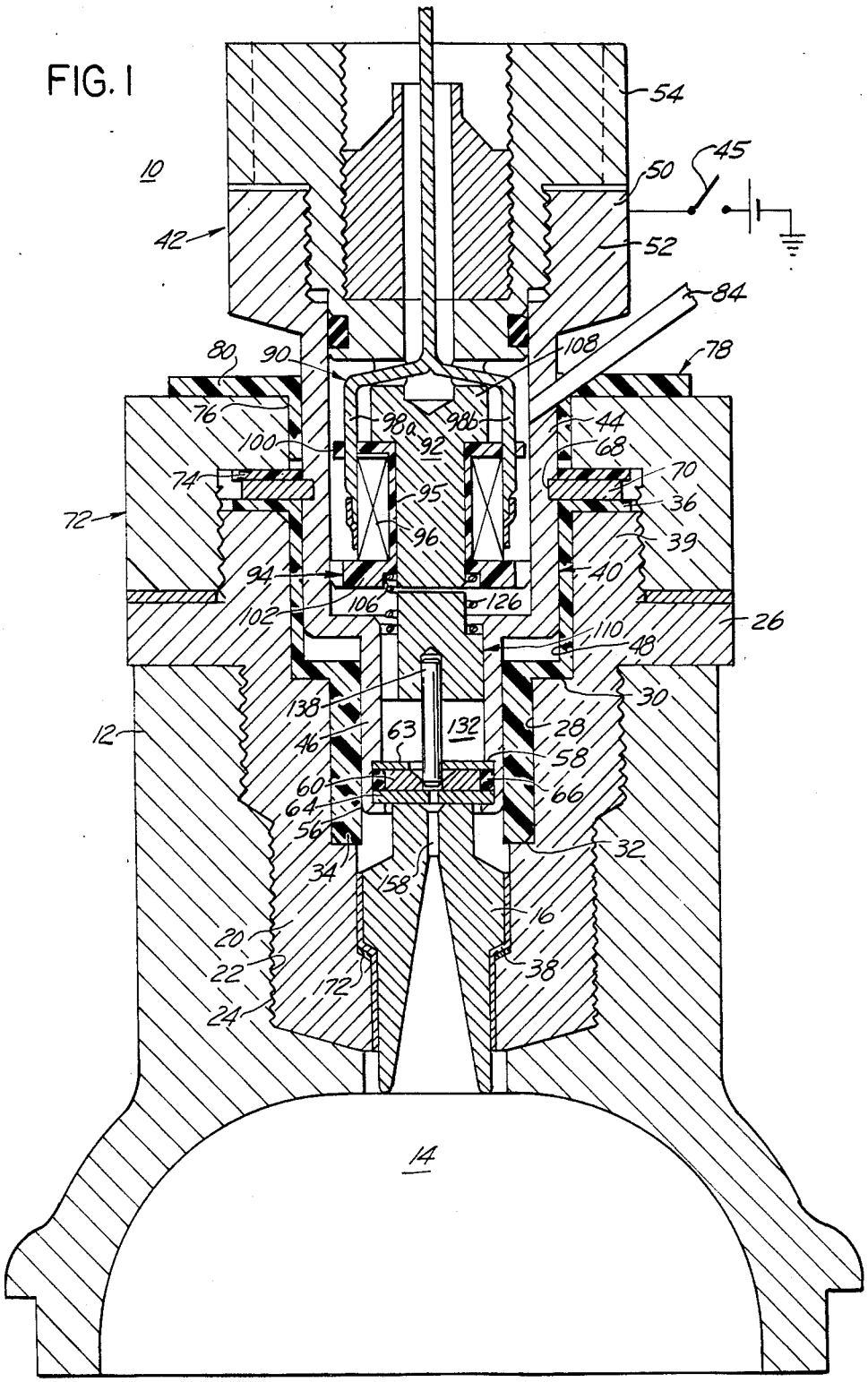
FIG. 1 is a cross-sectional view of the present invention.

With reference to FIG. 1, there is illustrated a vapor phase fuel injector 10 adapted to be received within the walls of a cylinder head 12 of an engine and inject fuel directly into the cylinder or a cylinder prechamber 14 through a heated nozzle 16. The fuel injector 10 comprises a lower jacket member 20 which is received within a cooperating bore 22 of the cylinder heat 12. More, specifically, the lower jacket member 20 may be threadably received into the bore 22 via threads 24. The lower jacket member 20 further includes a radially extending flange 26 which engages the top of the cylinder head 12. The lower jacket member 20 additionally includes a stepped bore 28 defining an upper shoulder 30, a lower shoulder 32 and a tapered shoulder 38 for securing the nozzle 16 therein. Received within the stepped bore 28 is a cylindrical electrically insulating member 34 fabricated of a non-conductive material such as nylon or plastic. The insulating member 34 comprises a radially extending flange 36 which is adapted to engage the upper end 39 of the lower jacket member 20. As can be seen for FIG. 1 the insulating member 34 extends from the upper or enlarged portion of the stepped bore 28 partially through the narrow or lower portion of the stepped bore 28 and is also supported on the shoulders 30 and 32.

Positioned interior to the insulating member 34 is a fuel injection valve member generally shown as 40. The member or valve 40 comprises a housing 42 which is received partially within the insulating member 34. The housing 42 may be made of a magneticably permeable material, such as low carbon or stainless steel. The housing 42 comprises an upper cylindrical housing portion 44 and a narrower, lower cylindrical housing portion 46 received within a stepped bore 48 formed by of the insulating member 34. The extending end 50 of the upper cylindrical portion includes a radial flange 52 adapted to threadably receive in a hollow nut 54. The lower end 56 of the lower cylindrical portion 46 comprises a groove 58 for securing therein a valve seat 60, a valve guide 62, an orifice plate 64, and an O-ring 66 positioned about the valve seat 60. The walls of the upper housing portion 44 include an annular groove 68 that is adapted to receive a spacer, such as a C-ring 70. Upon assembly, the housing 42, with C-ring 70 in place, is inserted into the insulating member 34 until the C-ring engages the flange 36 of the insulating member. The housing 42 is secured onto the lower jacket member 20 by a nut 72 which is threadably received on an axial projection of the lower housing member 20. An insulator ring 74 fabricated of plastic or the like may be inserted between the C-ring 70 and the nut 72. The nut 72 includes an inner wall 76 which is spaced from the injector housing 42. Another electrically insulating member 78 may be positioned between the nut 72 and the housing 42. Such member 78 may include a flanged portion 80.

Figure 2:
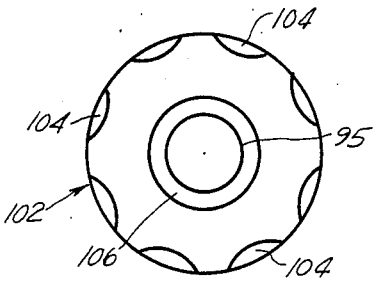
FIG. 2 is a cross-sectional view of a portion of a bobbin sowing flow pasages.

The injection member or valve 40 further includes means for communicating fuel thereto, such as an inlet passage generally designated as 84. Passage 84 communicates fuel to the interior of the housing 42. It should be appreciated, however, that the inlet passage 84 can be connected to any portion of the fuel injector 10 upstream of the valve seat 60. Positioned within the housing 42 is a solenoid assembly generally designated as 90. The solenoid assembly comprises a stator 92, a plastic bobbin 94 which may be molded directly to the stator 92 and an electrical coil 96 wound on the bobbin 94. A pair of electrodes 98*a* and 98*b* are electrically connected to the ends of the coil 96. The solenoid assembly 90 is so positioned within the interior of the housing 42 such as to permit fuel to flow thereabout, thereby cooling the coil 96. The bobbin 94 includes a central passage 95 through which is received the stator 92. More specifically, the bobbin includes an upper and a lower flange 100 and 102, respectively. The upper flange is of a smaller diameter than the inner walls of the upper housing portion 44. The lower flange 102, which is shown in greater detail in FIG. 2, includes a plurality of notches 104 to permit the unimpeded flow of fuel from the upper housing portion 44 to the lower housing portion 46. The lower flange further includes an annular recess 106 positioned about the central passage 95 of the bobbin 94 through which the stator 92 extends. In the embodiment of the invention illustrated in FIG. 1, the end of the stator terminates in the plane of a lower edge of the lower flange 102. The stator 92 further includes an enlarged upper end 108 which rests upon the upper flange 100 of the bobbin 94.

Figure 5:
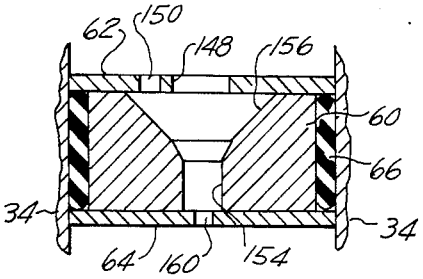
FIG. 5 is a cross-sectional view of a valve seat, valve guide and orifice plate.
Figure 3:
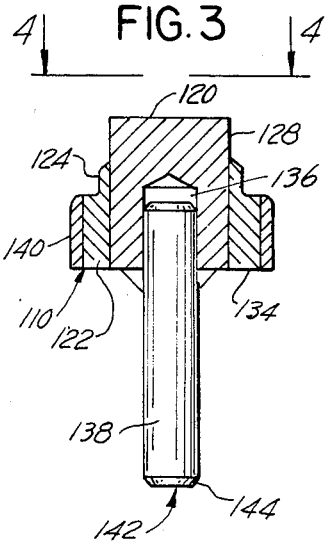
FIG. 3 is a portion of a cross-sectional view of an armature assembly.
Figure 6:
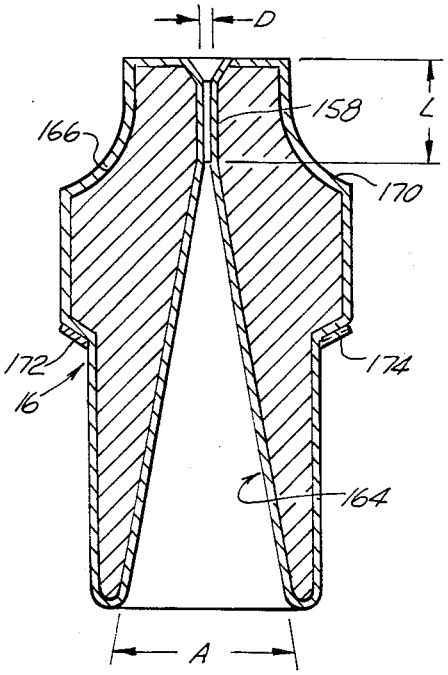
FIG. 6 is a cross-sectional view of a nozzle.
Figure 4:
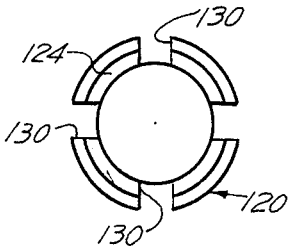
FIG. 4 is a side plan view of the armature assembly showing flow passages.

Positioned below the stator 92 is a movable armature assembly 110 slidably received within the lower housing portion 46. The armature assembly 110, which is also illustrated in FIG. 3, comprises an armature 120 which includes a radially extending flange 122 and an intermediate land 124, which is adapted to receive a biasing spring 126. One end of the biasing spring 126 being received about a narrow portion 128 the land 124 of the armature 120 and the other end of the spring 126 being received within the recess 106 of the bobbin 94. The armature 120 comprises a plurality of passages 130 (see FIG. 4) to permit fuel to flow therethrough into a fuel receiving chamber 132 positioned below the armature 120. As can be seen from the above, the sides of the enlarged end 134 of the armature 120 slidably engage the inner walls of the lower housing portion 46 the exterior walls of the enlarged end 134 or, alternatively, the inner walls of the housing 42, may be coated and/or plated with a non-magnetic material 140, such as copper, nickel, a plastic, or a ceramic. This coating prevents direct contact between the armature 120 and the housing 42 which would otherwise result in a high latent magnetic attractive force between these elements. This magnetic force would significantly increase the sliding friction between the armature and the housing, thereby impeding the reciprocation of the armature and increasing the response time of the fuel injector. The enlarged end 134 of the armature 120 comprises a bore 136 through which is press fit a pintle 138, the other end of which defines a closure element 142 having a preferably spherical end surface 144. The pintle is guided into seating engagement with the valve seat 60 by the guide 62 which is positioned against the shoulder or groove 58 at the lower extreme of the housing 42. The guide 62, shown in FIG. 5, includes a centrally located opening 148 through which the pintle 138 is received and at least one opening 150 to permit fuel to flow therethrough. Positioned below the guide member is the valve seat 60, preferably fabricated of a ceramic material to provide a thermal barrier, thereby insulating the fuel within the chamber 132 from the cylinder head 12, and which prevents heat stored in the nozzle 16 from being sinked into the metal housing. As previously mentioned, the O-ring 66 (see FIG. 1) is positioned about and secures the valve seat 60 within the housing 42. The valve seat 60 comprises a centrally located opening 154 which terminates at one end in a conically shaped valve seating surface 156. Positioned below the valve seat 60 is the injection or orifice plate 64, preferably of an electrically conductive material, such as brass. The valve guide 62, valve seat 60 and orifice plate 64 are secured together by the lower end of the housing member which may be crimped over as illustrated in FIG. 1. Positioned below the injection plate is a fuel vaporizing member or nozzle generally designated as 16, also shown in FIG. 6. The nozzle is fabricated of an engineering ceramic, such spark plug body material. $AL_2O_3$ is often used for spark plug bodies. The nozzle 16 comprises a first, narrow cylindrical passage 158 which is coaxially disposed relative to the opening 160 in the orifice plate 64. The diameter D of the passage 158 is substantially the same size as the diameter of the opening 160. An addition thermal barrier may be provided between the orifice plate 64 and the nozzle 16. Such barrier may comprises a flat ceramic disk (not shown) covered with a thin electrically conductive coating.

The passage 158 communicates with a conically shaped exit chamber 164. The exterior surface 166 and the interior walls of the nozzle 14 are preferably coated with a resistive film 170, such as platinum, gold, silver, etc., having a thickness of approximately a few microns. Such film 170 permits the nozzle 14 to be heated while not functioning as an efficient thermal conductor. The nozzle 16, proximate a shoulder 174 thereof is spaced from the jacket portion member 20 by a copper gasket 172 which permits the nozzle to be electrically grounded through the housing.

In operation, a positive voltage is applied to the upper housing portion 44 of the fuel injector housing 42 through a control which is generally shown as 45. Such positive voltage is communicated to the nozzle 14 through the electrically conductive housing 42 and orifice plate 64. In this manner, due to the applied voltage, when the engine is cold, the nozzle 14 can initially be maintained at a temperature not less than 700° C. which enhances fuel atomization and reduces carbon formation. Fuel is received through the inlet passage 84 and communicated through the various passages within the fuel injector into the chamber 132. Upon receipt of a control signal generated by an electronic control unit of known variety, the armature 120 retracts, thereby permitting fuel to flow through the valve seat 60, orifice plate 64, and nozzle 14. The structure of the nozzle 14 provides for a turbulent flow through the chamber 164 which, upon contact with the heated resistive film 170, vaporizes the fuel immediately prior to injection into the prechamber 14. After a period of time, after the engine is running, the voltage is removed, and the nozzle 16 is heated the combustion temperature. It can be shown that even at no load idle speeds the combustion temperature is sufficient to maintain the nozzle above 700° C..

In the preferred embodiment of the invention, the diameter D of passage 158 of the nozzle 16 is approximately 0.023 inches (0.0584 mm.) and the length L varies with the angle, generally designated as A, of the wall of chamber 164 of the nozzle 16. in this manner, the angle of spray of the fuel may be controlled to meet varying operating conditions. As an example, it has been found that the length L of passage 158 may vary between 0.0123 inches (3.124 mm.) and 0.443 inches (11.252 mm.) with a corresponding variation in the angle A from 19° through 11° or, alternatively presented, the ratio of L/D varies from approximately 5.35 to 19.26 as a function of the angle A.

FIGS. 7–11 illustrate an alternate embodiment of the vaporizing member or nozzle illustrated in FIG. 1. More specifically, the vaporizing member of nozzle 178 comprises a plurality of stacked ceramic disks 180*a–n*, each disk including a centrally located opening 182*a–n*. The openings of the disks vary in diameter in a manner such that they approximate the generally conical shape of the continuous inner nozzle surface shown in FIGS. 1 and 6. It should be appreciated that the steps formed in the nozzle's inner surface further encourage turbulent flow. Each of the ceramic disks supports a heating element 184 such as a thick film platinum conductor placed on one side 186 thereof as shown in FIG. 8. Each heating element 184 or conductor is covered by a protective glaze 188. The relationship of the disks 180, heating elements 184 and protective glaze is shown in the exploded, sectional view of FIG. 9. It should be noted that each of the elements shown therein are exaggerated in size for illustrative purposes. In actuality the thickness of the platinum conductors and glaze are only a few microns.

It is desirable to connect the plurality of heating elements in common and to thereafter connect the heating elements 184 appropriately to ground as well as to the positive voltage supply. This is accomplished by providing a pair of opposing grooves 190 and 192 in each disk 180. After the plurality of disks are mounted in the aligned stacked cylindrical configuration as illustrated in FIG. 7, a first conductive strip 194 is applied to one side of the nozzle 178 within the aligned grooves 190 thereby joining one side of each of the heating elements 184. This first strip 194 is connected to the positive voltage potential, such as by connection through the conductive orifice plate 64 or directly as shown. A second conductive strip 196 is applied to the other side of the nozzle 178 within the aligned grooves 192 thereby joining the other side of each of the heating elements 184. The strip 196 is connected to ground through a lower housing jacket 20' shown in dotted line. The jacket 20' may further include a shoulder 198 for securing the nozzle 178 therein. Alternatively, the nozzle 20' may include a shoulder such as shoulder 38 for engagement with the shoulder 200 of the nozzle 178. The plurality of disks 180 may be secured together by coating the exterior thereof with a protective glaze 202. If the disks 180 are sized to that the nozzle 178 includes a shoulder 200, the disk 204 proximate the shoulder 200 may be fabricated with enlarged, bi-furcated conductive surfaces 206, 208, on both sides thereof, without a heater element, to provide for a continuous electrical contract to adjacent disks 180 by way of attachment to the strips 194 and 196. In addition, an electrically conductive, thermal barrier 210 may be provided between the first disk, 180*a* and the orifice plate 64. Such thermal barrier 210 could also be constructed similar to the disk of FIG. 11.

Many changes and modifications in the above described embodiment of the invention can, of course, be carried out without departing from the scope thereof. Accordingly, that scope is intended to be limited only by the scope of the appended claims.

We claim:

1. A fuel injector comprising:

means including exit means for ejecting fuel through said exit means;

first means, adapted to be heated by external energy, positioned in surrounding relation to said exit means for receiving said fuel, for vaporizing said fuel and for causing said fuel to flow therethrough in a turbulent manner.

2. The device as defined in claim 1 wherein said first means comprises:

nozzle means positioned proximate said exit means comprising a non-conductive, heat storing nozzle including a narrow first portion, of predetermined length L and diameter D for receiving the fuel and a second portion, positioned downstream of said first portion, comprising an increasing diameter passage for causing, in cooperation with said first portion, the fuel to flow turbulently.

3. The device as defined in claim 2 wherein said nozzle means includes means, responsive to external energy, for heating the nozzle to a predetermined temperature.

4. The device as defined in claim 3 wherein said heating means comprises an electrically conductive, resistive, coating applied over said non-conductive nozzle.

5. The device as defined in claim 3 wherein said nozzle comprises a plurality of stacked non-conductive disks, each disk comprising a central opening therethrough, wherein the diameter of said opening of adjacent ones of said disks increases in a downstream direction.

6. The device as defined in claim 5 wherein at least said second portion of said nozzle is formed by said disks and wherein said increasing diameter portion is stepped.

7. The device as defined in claim 6 wherein various ones of said disks comprise a heater portion.

8. The device as defined in claim 7 wherein each heater portion comprises a conductor disposed upon a surface of said various disks.

9. The device as defined in claim 7 wherein said heater portion of a particular disk is separated from an adjacent surface of another disk by an electrically insulting member.

10. The device as defined in claim 9 wherein a plurality of remotely situated conductive paths are formed about said plurality of stacked disks, for joining, in electrical communication corresponding portions of each of said heater portion.

11. The device as defined in claim 10 wherein the resistance of each heater portion is chosen to produce a predetermined temperature gradient across said nozzle.

12. The device as defined in claim 10 wherein said heater portions, when activated, cooperated to maintain the steady state temperature of said disks at a temperature of not less than 700° C.

13. The device as defined in claim 11 wherein said disks are ceramic.

14. A fuel injection system comprising:

a fuel injector for injecting fuel directly into a diesel engine, comprising:

means, including exit means for ejecting fuel through said exit means;

first means, positioned in surrounding relation to said exit means, for receiving said fuel, for elevating said fuel to a predetermined temperature sufficient to vaporizes same and for causing said fuel to flow therethrough in a turbulent manner;

means for supplying electrical energy to said first means for elevating said first means to a predetermined temperature to cause said fuel to vaporize during instances when the temperature of the engine is less than said predetermined temperature and for removing said energy therefrom during instances when said engine has attained said temperature, wherein, after removal of such energy, said first means is operative to absorb heat directly from the combustion process within the engine such that it is maintained above said temperature.

15. The system is defined in claim 14 wherein said first means comprises:

nozzle means positioned proximate said exit means comprising a non-conductive, heat storing nozzle including a narrow first portion, of predetermined length L and diameter D, for receiving the fuel and a second portion, positioned downstream of said first portion, comprising an increasing diameter passage for causing, in cooperation with said first portion, the fuel to flow turbulently.

16. The system as defined in claim 15 wherein said nozzle means further includes means (170), responsive to the electrical energy, for heating the nozzle (16) to such predetermined temperature.

17. The system as defined in claim 16 wherein said heating means comprises an electrically conductive, resistive coating applied over said non-conductive nozzle.

18. The system as defined in claim 17 wherein said nozzle comprises a plurality of stacked non-conductive disks, each disk comprising a central opening therethrough, wherein the diameter of said opening of adjacent ones of said disks increases in a downstream direction.

19. The system as defined in claim 18 wherein said second portion of said nozzle is formed by said disks and wherein said increasing diameter portion is stepped.

20. The system as defined in claim 19 wherein various ones of said disks comprise a heater portion.

21. The system as defined in claim 20 wherein each heater portion comprises a conductor disposed to a surface of said various disk.

22. The system as defined in claim 20 wherein said heater portion of a particular disk is separated from an adjacent surface of another disk by an electrically insulting member.

23. The system as defined in claim 22 wherein a plurality of remotely situated conductive paths are formed about said plurality of stacked disks for joining, in electrical communication corresponding portions of each of said heater portions.

24. The system as defined in claim 23 wherein the resistance of each heater portion is chosen to produce a predetermined temperative gradient across said nozzle.

25. The system as defined in claim 23 wherein said heater portions, when activated, cooperated to maintain the steady state temperature of said disks at a temperature of not less than 700° C.

26. The system as defined in claim 24 wherein said disks are ceramic.

27. A method of operating a diesel engine having a cylinder and an injector disposed therein to inject fuel directly into the cylinder, the injector comprising:

a non-conductive, heat storing nozzle, at lease one heating element operatively disposed about said nozzle, said nozzle causing fuel to fuel turbulently therein and for atomizing said fuel when heated, the method comprising the steps of:

applying electrical energy to the heating element to raise the temperature of the nozzle to a predetermined temperature.

injecting fuel through the nozzle directly into the cylinder, causing the fuel to contact the heated nozzle and to be vaporized;

running the engine to an operating temperature sufficient for the combustion process within the cylinder to maintain the nozzle at the predetermined temperature, removing electrical energy from the heating element.

* * * * *